US007683840B2

(12) United States Patent
Lin et al.

(10) Patent No.: US 7,683,840 B2
(45) Date of Patent: Mar. 23, 2010

(54) INTEGRATED BROADBAND ANTENNA DEVICE WITH WIDE BAND FUNCTION

(75) Inventors: Yu-Ching Lin, Taipei (TW); Tsung-Wen Chiu, Taipei (TW); Fu-Ren Hsiao, Taipei (TW); Chun-Ching Lan, Taipei (TW); Yun-Fan Bai, Taipei (TW)

(73) Assignee: Advanced Connectek, Inc., Taipei (TW)

( * ) Notice: Subject to any disclaimer, the term of this patent is extended or adjusted under 35 U.S.C. 154(b) by 170 days.

(21) Appl. No.: 11/652,137

(22) Filed: Jan. 11, 2007

(65) Prior Publication Data

US 2008/0012777 A1 Jan. 17, 2008

(30) Foreign Application Priority Data

Jul. 14, 2006 (TW) ..... 95125855 A

(51) Int. Cl.
*H01Q 1/24* (2006.01)

(52) U.S. Cl. ..... 343/702

(58) Field of Classification Search ..... 343/702, 343/749, 752

See application file for complete search history.

(56) References Cited

U.S. PATENT DOCUMENTS 5,764,190 A 6/1998 Murch et al.
7,050,010 B2 * 5/2006 Wang et al. ..... 343/702
7,242,352 B2 * 7/2007 Tavassoli Hozouri . 343/700 MS

* cited by examiner

*Primary Examiner*—Hoang V Nguyen
*Assistant Examiner*—Robert Karacsony
(74) *Attorney, Agent, or Firm*—Schmeiser, Olsen & Watts LLP

(57) ABSTRACT

An integrated broadband antenna device with wide band function is disclosed. The antenna device comprises a ground plate, a feeding wire, a first metal radiator, a second metal radiator, a ground metal radiator and a parasitic metal radiator. The first metal radiator is connected with the positive ends of signals of the feeding wire for transmitting electric signals and producing a high frequency mode. The first metal radiator is coupled to and energizes the second metal radiator and the parasitic metal radiator, and then the two metal radiator producing a low frequency mode and a second high frequency mode along with the ground metal radiator obtains a wider bandwidth. The broadband antenna device integrating various kinds of antennas is able to have a enough bandwidth to meet the requirements of AMPS (824~894 MHz), GSM (880~960 MHz), GPS (1575 MHz), DCS (1710~1880 MHz), PCS (1850~1990 MHz), UMTS (1920~2170 MHz) and Wi-Fi (2400~2500 MHz).

2 Claims, 7 Drawing Sheets

INTEGRATED BROADBAND ANTENNA DEVICE WITH WIDE BAND FUNCTION

BACKGROUND OF THE INVENTION

1. Field of the Invention

The invention relates to an integrated broadband antenna device, and more particularly to a broadband antenna device which integrates various kinds of antennas to obtain a wider bandwidth.

2. Description of the Prior Art

The personal mobile communication technology has shown its immense potential and commercial value in the wireless communication industry. During its developing process, various systems adopting different techniques and channels have appeared, and they are applied to different geographic areas and markets. However, these differences bring much inconvenience to the manufacturers and customers, and the worst of all, these systems also use different frequencies such as GSM850, DCS1800 and UMTS.

Engineers in this field are trying their best to design a broadband integrated products in order to provide more convenience to users. However, the antenna is the key part when designing the mobile communication products, it is the starting point as well as the ending point of the wireless communication and its characteristics directly influence the transmission quality of the wireless signals. Therefore, the antenna device should meet the following requirements:

1. Frequency and Bandwidth
2. Radiating efficiency and radiating pattern of the antenna Since the design trend of electronic products towards lightness, thinness, shortness and smallness, the sizes of the antennas for communication products are becoming smaller and smaller. A Planar Inverted-F Antenna (referred to "PIFA-"hereinafter) that operates as a ¼ wavelength and can greatly decrease the size is extensively used as an inner-hidden antenna. A conventional PIFA shown in U.S. Pat. No. 5,764,190 can operate at a single frequency. In order to operate at multiple frequencies, PIFA defines an L-shaped slot or U-shaped groove on its radiation metal sheet to obtain multiple operational frequencies.

FIG. 1 shows another conventional antenna having multiple operational frequencies. The antenna device comprises a first radiation portion A, a second radiation portion B and a ground portion C. The first radiation portion A and the second radiation portion B extend respectively from both opposite sides of the same end of the ground portion C. The first radiation portion A comprises a first conductive patch A1 parallel to the ground portion C and a first connection portion A2 connected with the first conductive patch A1 and the ground portion C. The second radiation portion B comprises a second conductive patch B1 parallel to the ground portion C and a second connection portion B2 connected with the second conductive patch B1 and the ground portion C. The first conductive patch A1 and the second conductive patch B1 extend in the same direction from the first connection portion A2 and the second connection portion B2 respectively.

However, even the above-mentioned antennas can operate at multiple frequencies, they have the some disadvantages stated below. The first conductive patch A1 and the second conductive patch B1 are closely disposed, so the bandwidths for both low frequency and high frequency are not enough to cover various system frequency bands. Further, both feeding wire and the feeding point are close to the first connection portion A2, and such an arrangement is a conventional inverted-F antenna device which has a limited bandwidth and can not achieve a wider bandwidth.

The invention solves the above-mentioned problems by providing an integrated broadband antenna device. The antenna device integrates both characteristics and structures of various antennas including a monopole antenna, an inverted-F antenna and a parasitic antenna to produce a wide band and broadband functions simultaneously. Therefore, the antenna device according to the present invention not only has an innovative structure, but also greatly enlarges the frequency range to cover various system frequency bands. Obviously, the high application value is self-evident.

SUMMARY OF THE INVENTION

The primary object of the invention is to provide an integrated broadband antenna device with wide band function, which can realize broadband function at high frequency by integrating the structures of various antennas to achieve the desired bandwidth (1575~2500 MHz). Therefore, the requirements for the system bandwidths of GPS, DCS, PCS, UMTS, Wi-Fi can be met.

Another object of the invention is to provide an integrated broadband antenna device with wide band function, which can realize broadband function at low frequency by integrating the structures of various antennas to achieve the desired bandwidth (824~960 MHz). Therefore, the requirements for the system bandwidths of AMPS and GSM can be met.

To fulfill the above-mentioned objects, the broadband antenna device according to this invention has the following characteristics. The antenna device substantially comprises a ground plate, a feeding wire, a first metal radiator, a second metal radiator, a ground metal radiator and a parasitic metal radiator. The ground plate is connected with the negative signal wire of the feeding wire and the first metal radiator that horizontally suspends above the ground plate connected with the positive one for the purpose of transmitting electric signals. Additionally, the first metal radiator forms a monopole antenna device to produce a first high frequency mode. The second metal radiator includes a first end and a second end. The first end is adjacent to the first metal radiator with a clearance therebetween. The first metal radiator is coupled and feeds the electric signals to the second metal radiator, and the second end of the second metal radiator is connected with the ground metal radiator, and thus electrical grounding is realized. The first and second metal radiator and the ground metal radiator form an inverted-F antenna device to produce a low frequency mode. Referring to the inverted-F antenna, the signals are fed to by the first end of the second metal radiator which is one end away from the ground end. In this structure, the current distribution on the surface of this antenna device is more even to effectively enlarge the bandwidth, moreover, and the better impedance matching can be obtained by adequate adjustment of the clearance between the first and the second metal radiator. Furthermore, the parasitic metal radiator and the ground metal radiator constitute a parasitic antenna device which can produce a second high frequency mode. The second high frequency mode and the first high frequency mode constitute a broadband mode which greatly enlarges the high frequency bandwidth.

The first metal radiator according to this invention can not only form a monopole antenna, but also has the function of signal feeding of the inverted-F antenna. Furthermore, the parasitic antenna device and the inverted-F antenna device share the ground metal radiator, thus it is obvious that the integrated antenna device which integrates the structures of various kinds of antennas has many excellent characteristics.

Other objects, functions and advantages of the invention will become more apparent from the following detailed description of the preferred embodiments.

DETAILED DESCRIPTION OF THE PREFERRED EMBODIMENT

Figure 1:
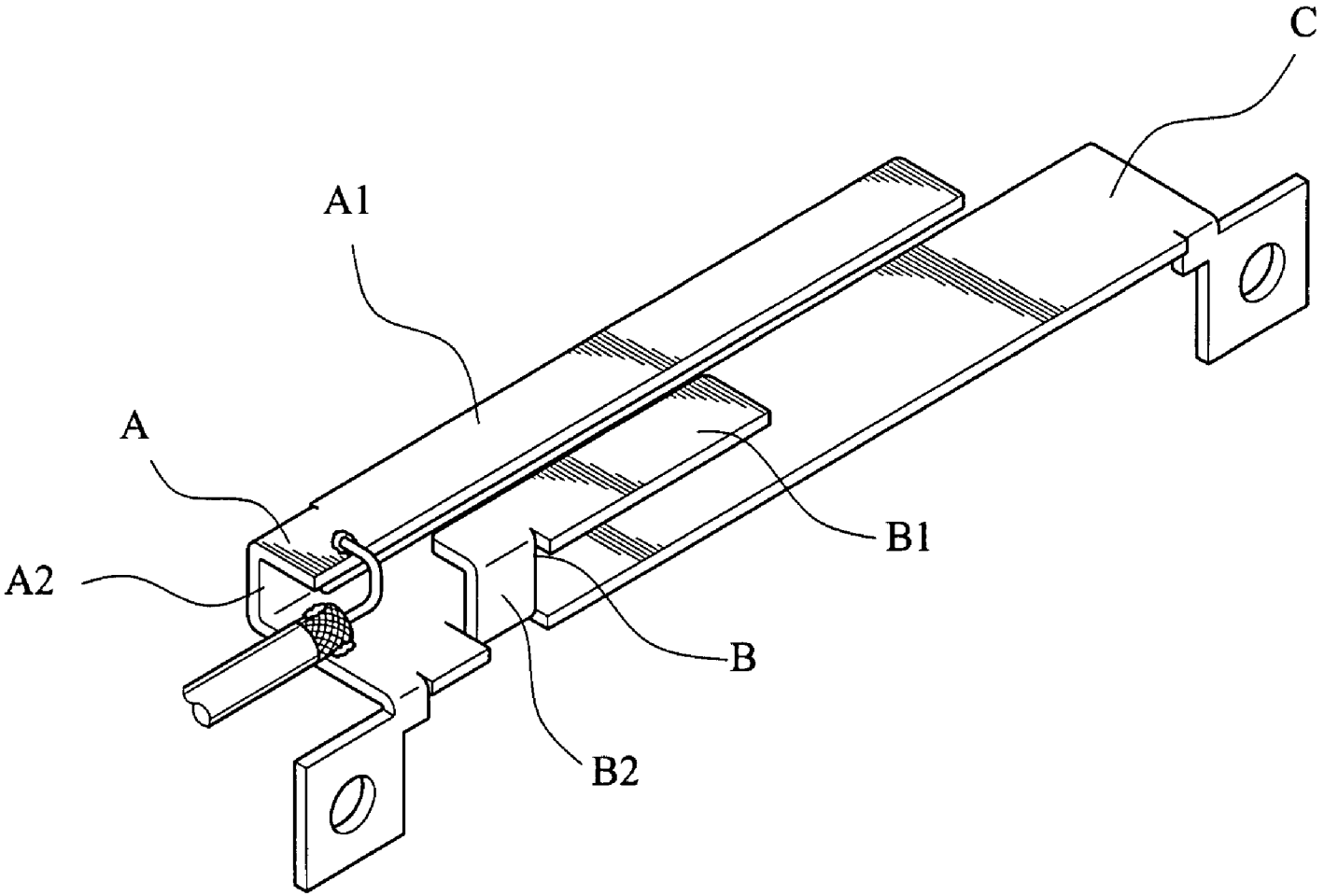
FIG. 1(Prior Art)
FIG. 1 is a perspective view showing a prior broadband antenna.
Figure 2:
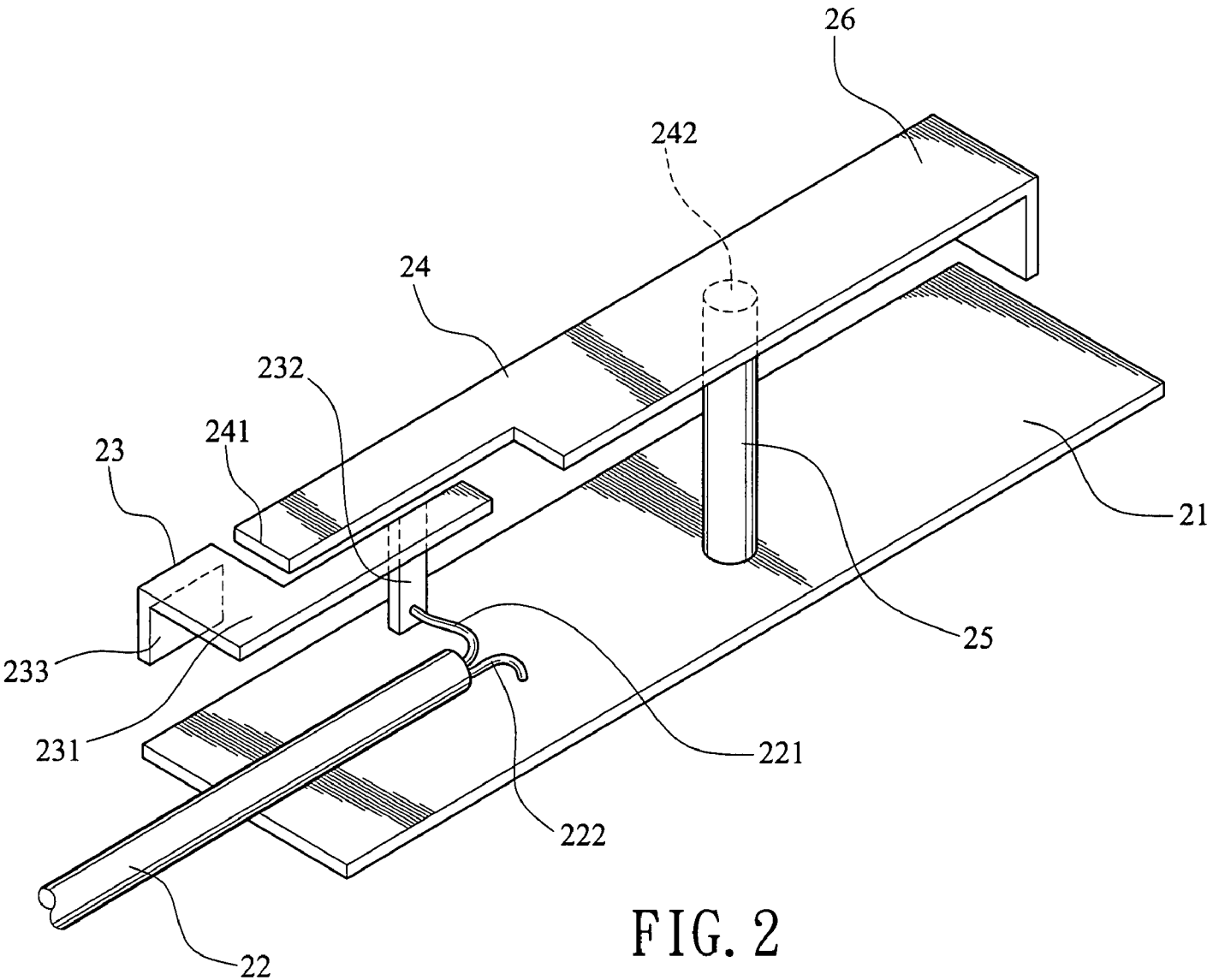
FIG. 2 is a perspective view showing an antenna device according to a first embodiment of the present invention.

FIG 2 shows the first preferred embodiment of an integrated broadband antenna device with wide band function. The antenna device comprises a ground plate 21, a feeding wire 22, a first metal radiator 23, a second metal radiator 24, a ground metal radiator 25 and a parasitic metal radiator 26. The feeding wire 22 comprises a positive signal wire 221 and a negative signal wire 222 electrically connected with the ground plate 21. The first metal radiator 23 includes a radiating arm 231 and a feeding metal sheet 232. The radiating arm 231 is provided on one side of the ground plate 21 and horizontally suspends above ground plate 21. Therefore, the radiating arm 231 is not in contact with the ground plate 21. The radiating arm 231 further has a side wing 233, and the parasitic metal radiator 26 is substantially an inverted L-shaped structure. The feeding metal sheet 232 is perpendicular to the ground plate 21 with one end thereof connected with the radiating arm 231 and the other end thereof connected with the positive signal wire 221 of the feeding wire 22 for transmitting electric signals. The first metal radiator 23 forms a monopole antenna for producing a first high frequency mode. The second metal radiator 24 horizontally suspends above the ground plate 21 and includes a second end 242 and a first end 241 which is adjacent to the radiating arm 231 of the first metal radiator 23 with a clearance therebetween. The second end 242 extends in a direction that is away from the radiating arm 231, and the first end 241 and the radiating arm 242 are substantially on the same surface. The ground metal radiator 25 is vertical to the ground plate 21 with one end thereof connected with the ground plate 21 and the other end thereof connected with the second end 242 of the second metal radiator 24. According to the invention, the electric signals are coupled to and fed to the first end 241 of the second metal radiator 24 via the radiating arm 231 of the first metal radiator 23, and then the second metal radiator 24 as well as the ground metal radiator 25 form an inverted-F antenna device to produce a low frequency mode. In additional, the parasitic metal radiator 26 horizontally suspends above the ground plate 21, and one end thereof is connected with the ground metal radiator 25 and the second end 242 of the second metal radiator 24 and the other end thereof extends in a direction that is away from the ground metal radiator 25. The parasitic metal radiator 26 and the ground metal radiator 25 constitute a parasitic antenna device which produces a second high frequency mode. The second high frequency mode as well as the first high frequency mode constitute a wide band mode.

Figure 3:
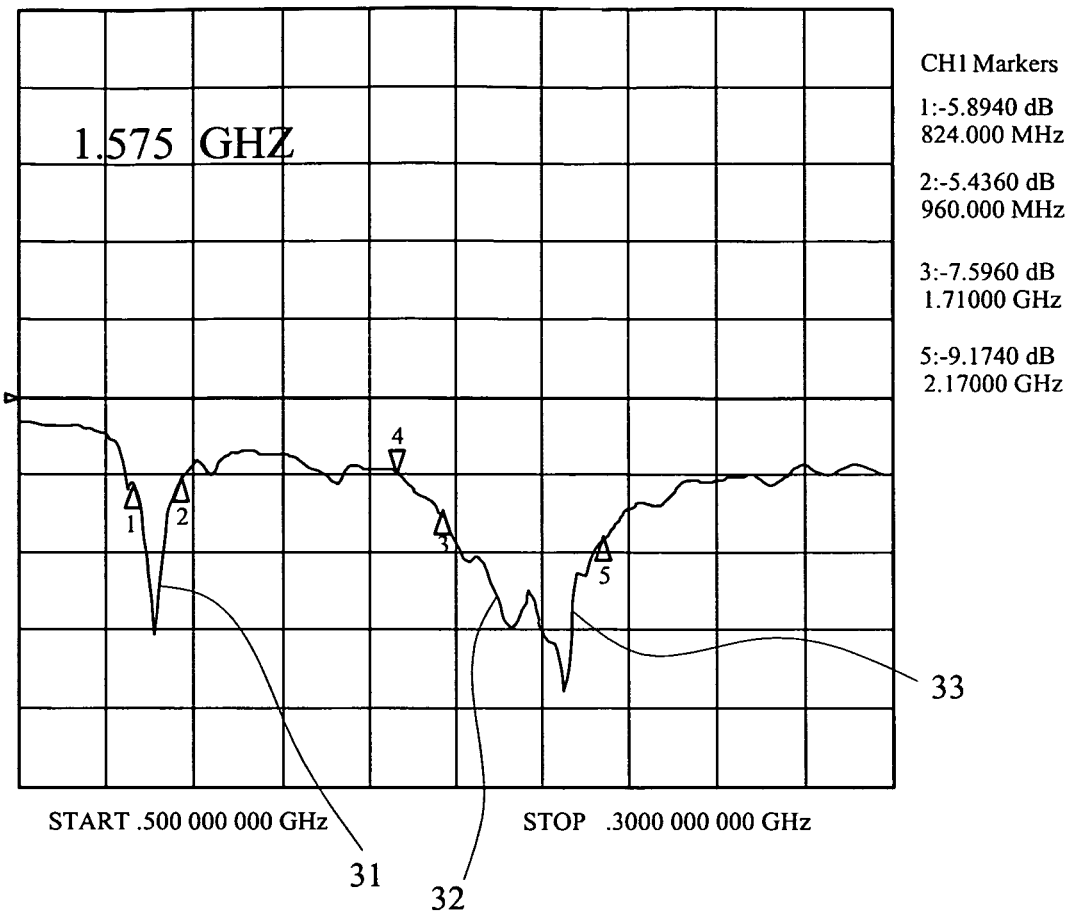
FIG. 3 is a plot showing the measurement result of the return loss of the antenna device shown in FIG. 2.

FIG. 3 plots the measurement result of the return loss of the integrated broadband antenna device with wide band function. As shown in the plot, the antenna device produces three operational modes, in which the low frequency mode 31 satisfies the requirements of both AMPS (824~894 MHz) and GSM (880~960 MHz), a wide band mode which is constituted by the first high frequency mode 32 and the second high frequency 33 can meet the requirements of GPS (1575 MHz), DCS (1710~1880 MHz), PCS (1850~1990 MHz), UMTS (1920~2170 MHz), Wi-Fi (2400~2500 MHz). The antenna device has excellent characteristics.

Figure 4:
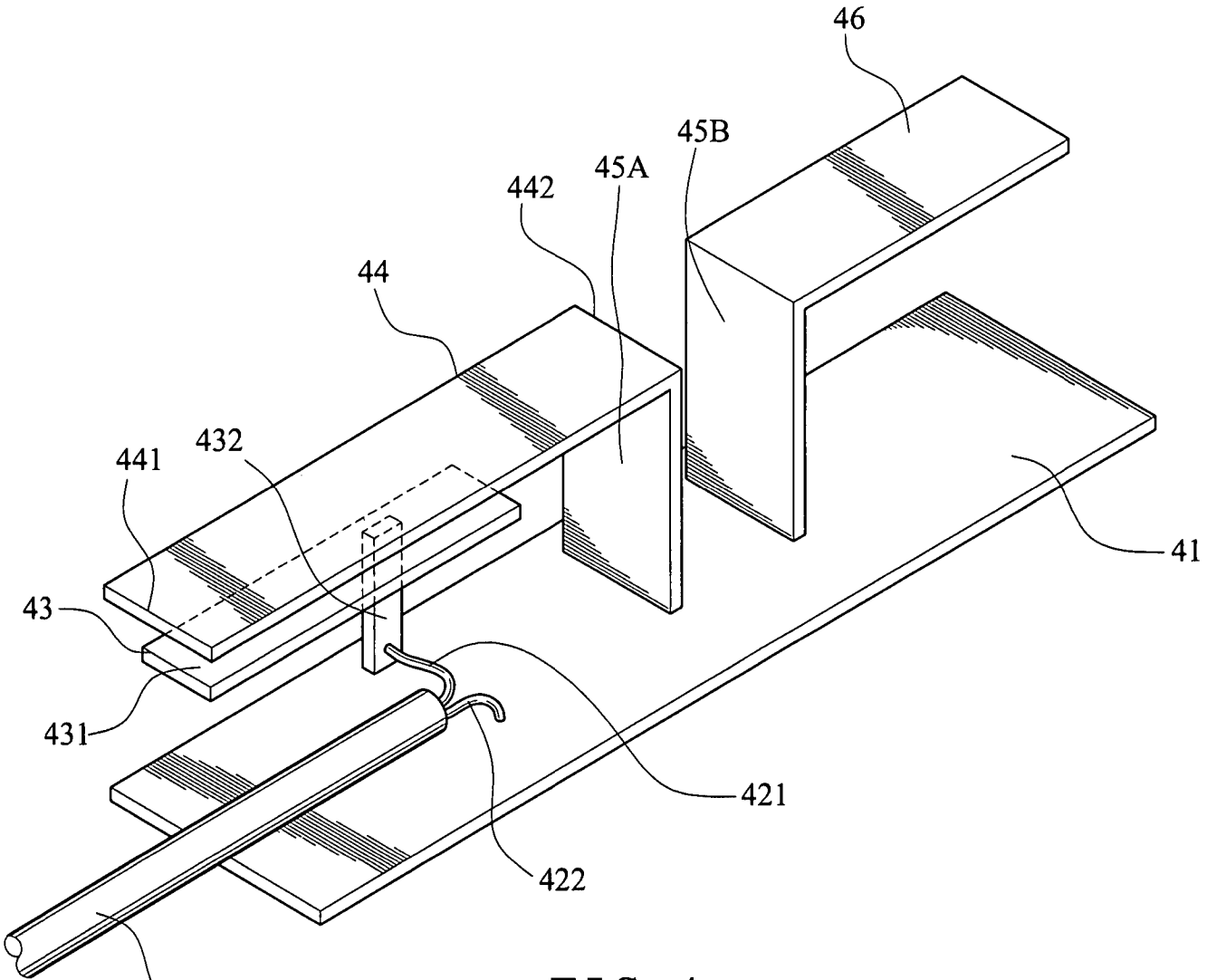
FIG. 4 is a perspective view showing an antenna device according to a second embodiment of the present invention.

FIG. 4 shows the second preferred embodiment of the integrated broadband antenna device with wide band function. The antenna device comprises a ground plate 41, a feeding wire 42, a first metal radiator 43, a second metal radiator 44, a first and second ground metal radiators 45A and 45B and a parasitic metal radiator 46. The feeding wire 42 comprises a positive signal wire 421 and a negative signal wire 422 that is electrically connected with the ground plate 41. The first metal radiator 43 includes a radiating arm 431 and a feeding metal sheet 432, the radiating arm 431 is disposed on one side of the ground plate 41 and horizontally suspends above the ground plate 41. A clearance is formed between the radiating arm 431 and the ground plate 41. The feeding metal sheet 432 is perpendicular to the ground plate 41 with one end thereof connected with the radiating arm 431 and the other end thereof connected with the positive signal wire 421 of the feeding wire 42 for transmitting electric signals. The first metal radiator 43 forms a monopole antenna device to produce a first high frequency mode. The second metal radiator 44 which horizontally suspends above the ground plate 41 includes a second end 442 and a first end 441 which is adjacent to the radiating arm 431 of the first metal radiator 43 with a clearance therebetween. The second end 442 extends in a direction that is away from the radiating arm 431. The first end 441 and the radiating arm 431 are on different levels and the former is farther away from the ground plate 41 than the latter. Each of the two ground metal radiators 45A and 45B is vertical to the ground plate 41 with one end thereof connected with the ground plate 41 and the other end of second ground metal radiator 45B connected with the parasitic metal radiator 46 and the other end of first ground metal radiator 45A connected with the second end 442 of the second metal radiator 44 respectively. The two ground metal radiators 45A and 45B have a clearance therebetween. In additional, the parasitic metal radiator 46 horizontally suspends above the ground plate 41, and one end thereof is connected with the ground metal radiator 45, and the other end thereof extends in a direction that is away from the ground metal radiator 45. According to the invention, the electric signals are coupled to and fed to the first end 441 of the second metal radiator 44 by the radiating arm 431 of the first metal radiator 43. Therefore, the second metal radiator 44, along with the ground metal radiator 45, forms an inverted-F antenna device to produce a low frequency mode. The parasitic metal radiator 46 and the ground metal radiator 45 constitute a parasitic antenna device which produces a second high frequency mode. The second high frequency mode along with the first high frequency mode constitutes a wide band mode. In the same time, the two ground metal radiators according to this invention could be integrated as a single ground metal radiator, and the above-mentioned two antennas, the inverted-F antenna device and the parasitic antenna share the ground metal radiator 45. Therefore, not only the manufacturing process of the antenna is simplified but also the size of the antenna is decreased.

Figure 5:
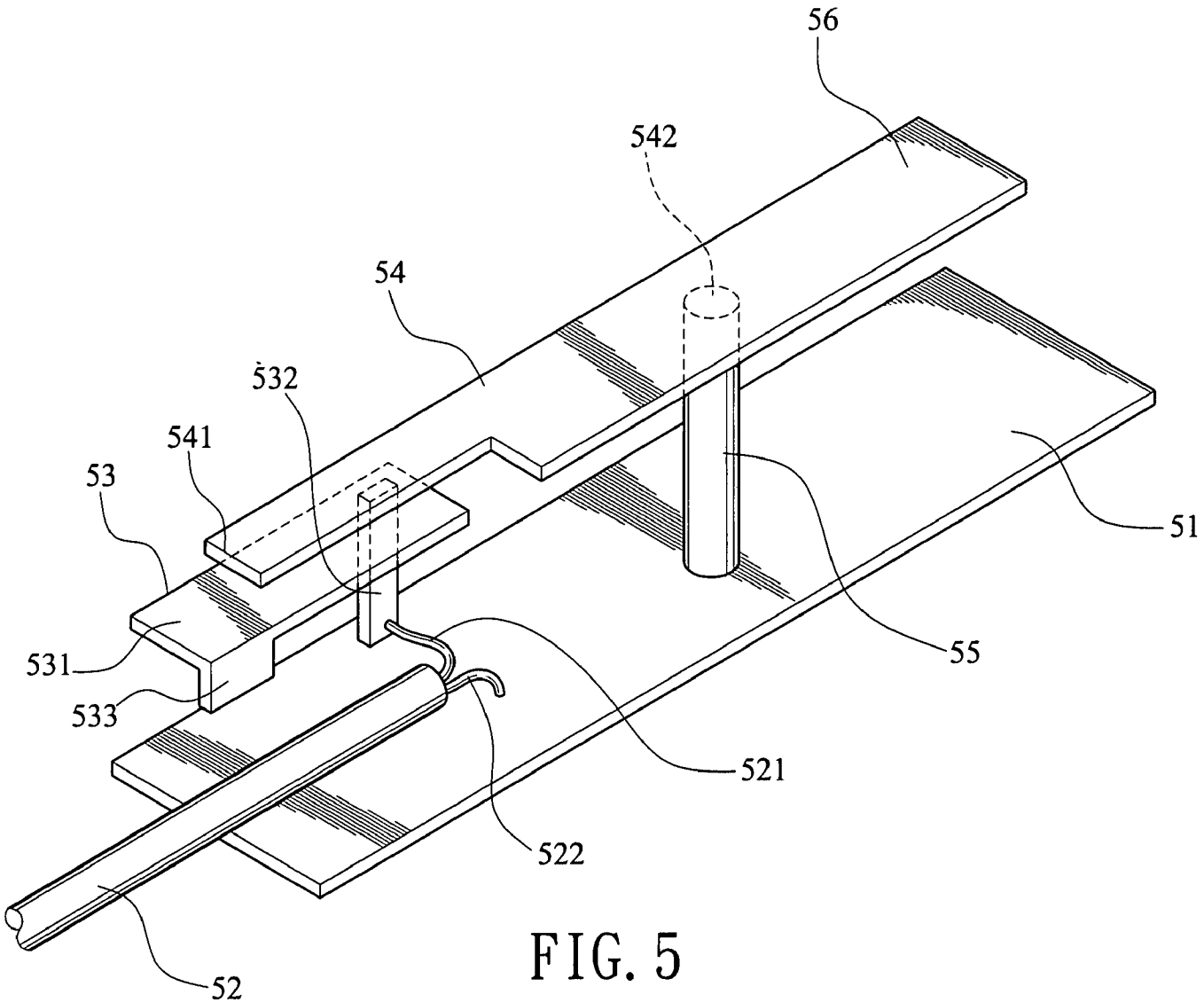
FIG. 5 is a perspective view showing an antenna device according to a third embodiment of the present invention.

FIG 5 shows the third preferred embodiment of the integrated broadband antenna device with wide band function. The antenna device comprises a ground plate 51, a feeding wire 52, a first metal radiator 53, a second metal radiator 54, a ground metal radiator 55 and a parasitic metal radiator 56. The feeding wire 52 comprises a positive signal wire 521 and a negative signal wire 522 that is electrically connected with the ground plate 51. The first metal radiator 53 includes a radiating arm 531 and a feeding metal sheet 532, the radiating arm 531 is located on one side of the ground plate 51 and horizontally suspends above the ground plate 51. In fact, a clearance is formed between the radiating arm 531 and the ground plate 51. The radiating arm 531 also has a side wing 533 and the parasitic metal radiator is substantially inverted L-shaped as a whole. The feeding metal sheet 532 is perpendicular to the ground plate 51 with one end thereof connected with the radiating arm 531 and the other end thereof connected with the positive signal wire 521 of the feeding wire 52 for transmitting electric signals. The first metal radiator 53 forms a monopole antenna to produce a first high frequency mode. The second metal radiator 54 which horizontally suspends above the ground plate 51 includes a second end 542 and a first end 541 which is adjacent to the radiating arm 531 of the first metal radiator 53 with a clearance therebetween. The second end 542 extends in a direction that is away from the radiating arm 531, the first end 541 and the radiating arm 542 are on different levels and the former is farther away from the ground plate 51 than the latter. The ground metal radiator 55 is vertical to the ground plate 51 with one end thereof connected with the ground plate 51 and the other end thereof connected with the second end 54 of the second metal radiator 542. According to the invention, the electric signals are coupled to and fed to the first end 541 of the second metal radiator 54 by the radiating arm 531 of the first metal radiator 53. Therefore, the second metal radiator 54 along with the ground metal radiator 55 forms an inverted-F antenna for producing a low frequency mode. In additional, the parasitic metal radiator 56 horizontally suspends above the ground plate 51, and one end thereof is connected with the ground metal radiator 55 and the second end 542 of the second metal radiator 54 respectively, and the other end thereof extends in a direction that is away from the ground metal radiator 55. The parasitic metal radiator 56 and the ground metal radiator 55 constitute a parasitic antenna device which can produce a second high frequency mode. The second high frequency mode along with the first high frequency mode simultaneously constitutes a wide band mode.

Figure 6:
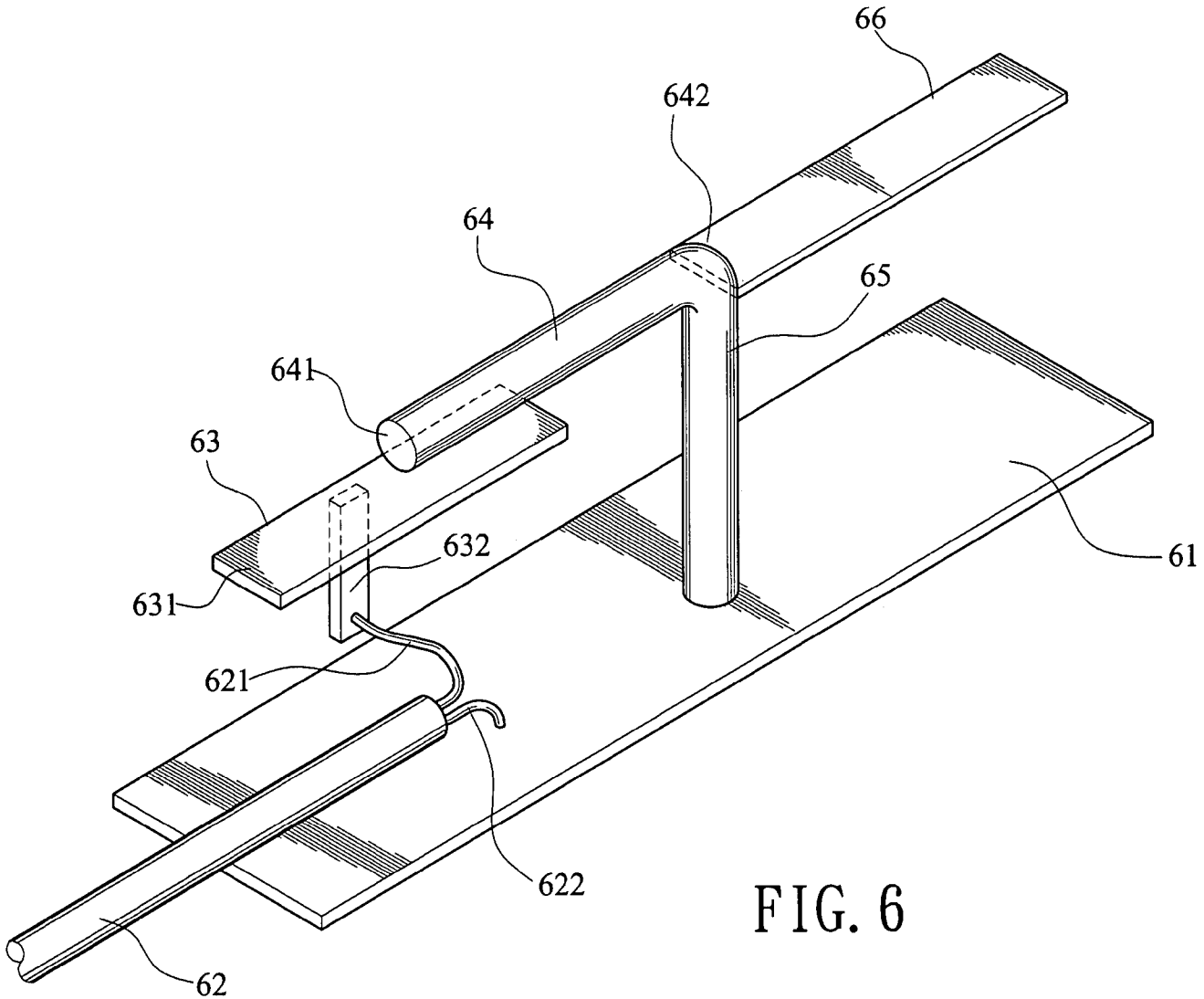
FIG. 6 is a perspective view showing an antenna device according to a fourth embodiment of the present invention.

FIG. 6 shows the fourth preferred embodiment of the integrated broadband antenna device with wide band function. The antenna device comprises a ground plate 61, a feeding wire 62, a first metal radiator 63, a second metal radiator 64, a ground metal radiator 65 and a parasitic metal radiator 66. The feeding wire 62 comprises a positive signal wire 621 and a negative signal wire 622 that is electrically connected with the ground plate 61. The first metal radiator 63 includes a radiating arm 631 and a feeding metal sheet 632, the radiating arm 631 is located on one side of the ground plate 61 and horizontally suspends above the ground plate 61. In fact, a clearance is formed between the radiating arm 631 and the ground plate 61. The feeding metal sheet 632 is perpendicular to the ground plate 61 with one end thereof connected with the radiating arm 631 and the other end thereof connected with the positive signal wire 621 of the feeding wire 62 for transmitting electric signals. The first metal radiator 63 forms a monopole antenna device to produce a first high frequency mode. The second metal radiator 64 which horizontally suspends above the ground plate 61 includes a second end 642 and a first end 641 which is adjacent to the radiating arm 631 of the first metal radiator 63 with a clearance therebetween. The second end 642 extends in a direction that is away from the radiating arm 631. The first end 641 and the second end 642 of the second metal radiator 64 are on different levels and the former is farther away from the ground plate 61 than the latter. The second metal radiator 64 is substantially of a cylinder shape. The ground metal radiator 65 is vertical to the ground plate 61 with one end thereof connected with the ground plate 61 and the other end thereof connected with the second end 642 of the second metal radiator 64. According to the invention, the electric signals are coupled to and fed to the first end 641 of the second metal radiator 64 by the radiating arm 631 of the first metal radiator 63. Therefore, the second metal radiator 64 along with the ground metal radiator 65 forms an inverted-F antenna for producing a low frequency mode. In additional, the parasitic metal radiator 66 horizontally suspends above the ground plate 61, and one end thereof is respectively connected with the ground metal radiator 65 and the second end 642 of the second metal radiator 64, and the other end thereof extends in a direction that is away from the ground metal radiator 65. The parasitic metal radiator 66 and the second metal radiator 64 form an obtuse angle therebetween. The parasitic metal radiator 66 and the ground metal radiator 65 constitute a parasitic antenna device which can produce a second high frequency mode. The second high frequency along with the first high frequency mode constitutes a wide band mode.

Figure 7:
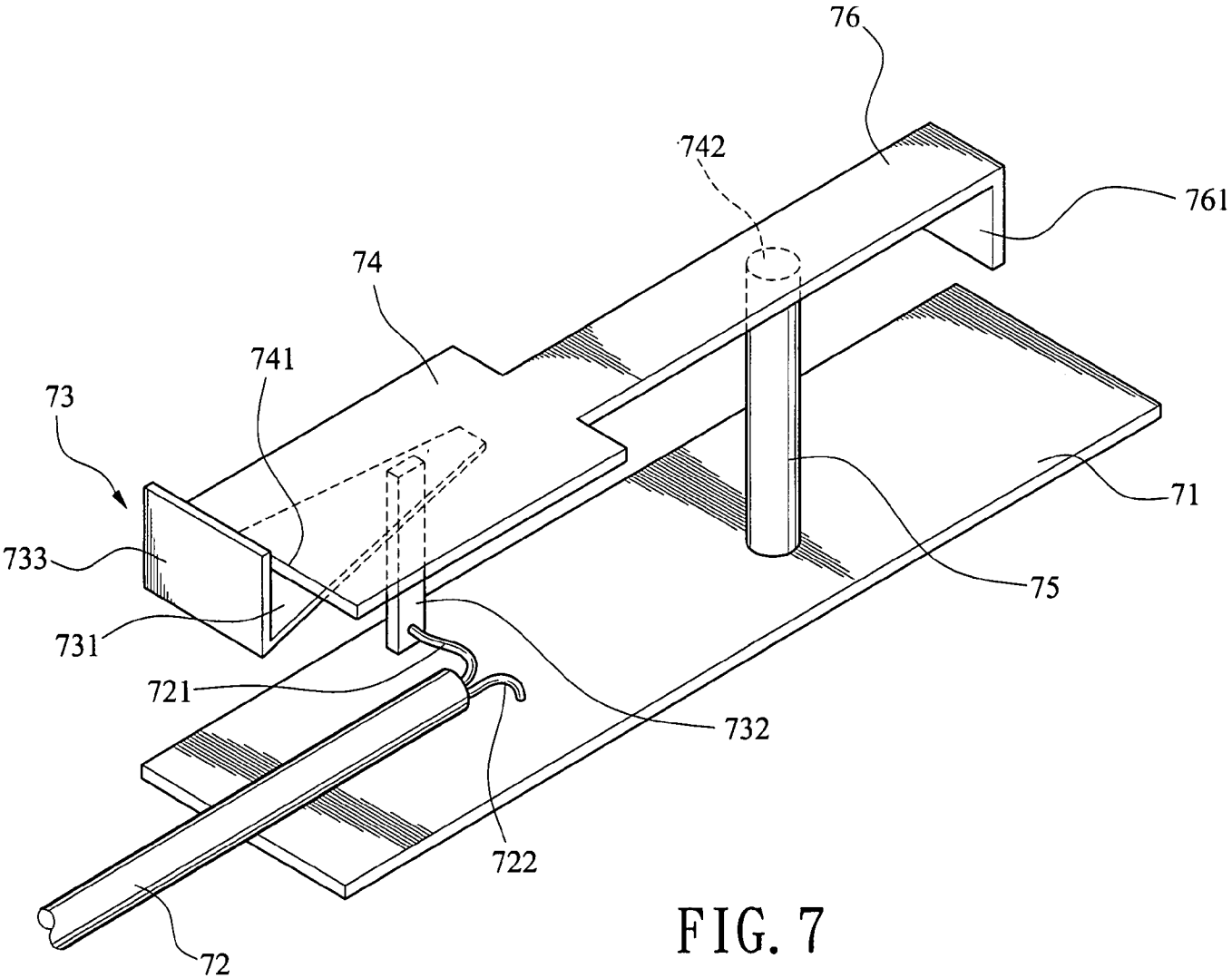
FIG. 7 is a perspective view showing an antenna device according to a fifth embodiment of the present invention.

FIG 7 shows the fifth preferred embodiment of the integrated broadband antenna device with wide band function. The antenna device comprises a ground plate 71, a feeding wire 72, a first metal radiator 73, a second metal radiator 74, a ground metal radiator 75 and a parasitic metal radiator 76. The feeding wire 72 comprises a positive signal wire 721 and a negative signal wire 722 that is electrically connected with the ground plate 71. The first metal radiator 73 includes a radiating arm 731 and a feeding metal sheet 732. The radiating arm 731 is located on one side of the ground plate 71 and horizontally suspends above the ground plate 71. In fact, a clearance is formed between the radiating arm 731 and the ground plate 71. The radiating arm 731 further has a side wing 733 and the radiating arm 731 is inverted-L shape as a whole. The feeding metal sheet 732 is perpendicular to the ground plate 71 with one end thereof connected with the radiating arm 731 and the other end thereof connected with the positive signal wire 721 of the feeding wire 72 for transmitting electric signals. The first metal radiator 73 forms a monopole antenna device to produce a first high frequency mode. The second metal radiator 74 which horizontally suspends above the ground plate 71 includes a second end 742 and a first end 741 which is adjacent to the radiating arm 731 of the first metal radiator 73 with a clearance therebetween. The second end 742 extends in a direction that is away from the radiating arm 731. The first end 741 and the radiating arm 742 are on different levels, and the former is farther away from the ground plate 71 than the latter and also wider than the second end 742. The ground metal radiator 75 is vertical to the ground plate 71 with one end thereof connected with the ground plate 71 and the other end thereof connected with the second end 742 of the second metal radiator 74. According to the invention, the electric signals are coupled to and fed to the first end 741 of the second metal radiator 74 by the radiating arm 731 of the first metal radiator 73. Therefore, the second metal radiator 74 along with the ground metal radiator 75 forms an inverted-F antenna device for producing a low frequency mode. In additional, the parasitic metal radiator 76 horizontally suspends above the ground plate 71, and one end thereof is connected respectively with the ground metal radiator 75 and the second end 742 of the second metal radiator 74, and the other end thereof extends in a direction that is away from the ground metal radiator 75. The parasitic metal radiator 76 is provided with a side wing 761 on the second end thereof, and therefore the radiating arm is of an inverted-L shape as a whole. The parasitic metal radiator 76 and the ground metal radiator 75 constitute a parasitic antenna which can produce a second high frequency mode. The second high frequency mode along with the first high frequency mode constitutes a wide band mode.

The description and drawings are only for illustrating preferred embodiments of the present invention, and not for giving any limitation to the scope of the present invention. It will be apparent to those skilled in this art that various modifications or changes without departing from the spirit, scope and characteristic of this invention shall also fall within the scope of the appended claims of the present invention.

What is claimed is:

1. An antenna device comprising:

a ground plate;

a feeding wire including a positive signal wire and a negative signal wire electrically connected with the ground plate;

a first metal radiator including a radiating arm and a feeding metal sheet, the radiating arm provided on one side of the ground plate and horizontally suspending above the ground plate, the feeding metal sheet vertically arranged with respect to the ground plate with one end thereof being vertically connected to the radiating arm and the other end thereof connected with the positive signal wire of the feeding wire and the ground plate;

a second metal radiator horizontally suspending above the ground plate including a first end and a second end, the first end being adjacent to the radiating arm with a clearance formed therebetween, the second end extending away from the radiating arm of the first metal radiator;

a ground metal radiator vertically arranged with respect to the ground plate with one end thereof connected with the ground plate and the other end thereof connected with the second end of the second metal radiator; and a parasitic metal radiator horizontally suspending above the ground plate, one end thereof connected with the ground metal radiator and the other end thereof extending away from the ground metal radiator;

wherein the first metal radiator has a side wing and is substantially of an L-shape;

wherein the radiating arm of the first metal radiator and the first end of the second metal radiator are not on the same level, and the first end of the second metal radiator is farther away from the ground plate than the radiating arm of the first metal radiator;

wherein the parasitic metal radiator and the second metal radiator form an obtuse angle therebetween;

wherein the parasitic metal radiator has a side wing and is substantially of an L-shape;

wherein the first end of the second metal radiator is less than the second end of the second metal radiator;

wherein a first end and a second end of the radiating arm are extended horizontally on different levels;

wherein the ground metal radiator comprises a first ground metal radiator and a second ground metal radiator and having a clearance therebetween and one end of the first and the second ground metal radiators is vertically connected to the ground plate, the other end of the second ground metal radiator connected with the parasitic metal radiator and the other end of the first ground metal radiator connected with the second end of the second metal radiator respectively;

wherein the parasitic metal radiator and the ground metal radiator constitute a parasitic antenna device which produces a second high frequency mode, and the second high frequency mode as well as the first high frequency mode constitute a wide band mode;

a length of areas of the second metal radiator and the parasitic metal radiator is ten times larger than that of widths of the second metal radiator and the parasitic metal radiator.

2. The antenna device according to claim 1, wherein the second metal radiator is substantially in the form of a cylinder shape.

* * * * *